US006880329B2

(12) United States Patent
Iida et al.

(10) Patent No.: US 6,880,329 B2
(45) Date of Patent: Apr. 19, 2005

(54) EXHAUST GAS PURIFYING SYSTEM FOR INTERNAL COMBUSTION ENGINES

(75) Inventors: Hisashi Iida, Kariya (JP); Mitsuo Hara, Ichinomiya (JP); Hideki Suzuki, Chita-gun (JP); Yoshiyuki Okamoto, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/408,121

(22) Filed: Apr. 8, 2003

(65) Prior Publication Data

US 2003/0196428 A1 Oct. 23, 2003

(30) Foreign Application Priority Data

Apr. 23, 2002 (JP) ..... 2002-121306

(51) Int. Cl.[7] ..... F01N 3/00

(52) U.S. Cl. ..... 60/285; 60/274; 60/276; 123/689; 73/118.1

(58) Field of Search ..... 60/276, 277, 285, 60/274; 123/688, 689; 73/118.1, 23.32

(56) References Cited

U.S. PATENT DOCUMENTS 5,263,358 A 11/1993 Center et al.
5,996,337 A * 12/1999 Blosser et al. ..... 60/274
6,082,345 A * 7/2000 Ikeuchi et al. ..... 123/689
6,164,125 A * 12/2000 Kawase et al. ..... 73/118.1
6,210,641 B1 * 4/2001 Yamada et al. ..... 422/94
6,304,813 B1 * 10/2001 Ikeda et al. ..... 701/109

FOREIGN PATENT DOCUMENTS

JP 9-127035 5/1997

* cited by examiner

*Primary Examiner*—Binh Q. Tran
(74) *Attorney, Agent, or Firm*—Nixon & Vanderhye P.C.

(57) ABSTRACT

A first oxygen sensor is mounted on an exhaust pipe. An ECU determines an electric power to be fed to a sensor heater, by a heater control quantity calculating block, in accordance with a difference between an actual impedance and a target impedance calculated by a running condition determining block and a specific gas sensitivity priority determining block. As a result, the detection sensitivity of the oxygen sensor to a rich component or a lean component is improved according to the running condition. This improved output is detected by an output detecting block and reflected on the air/fuel ratio control so that an air/fuel ratio is controlled thereby.

23 Claims, 12 Drawing Sheets

| QA(g/s) | 5 | 10 | 15 | 20 | 30 | 40 | 50 |
|---|---|---|---|---|---|---|---|
| λIR | 0.12 | 0.08 | 0.05 | 0.04 | 0.03 | 0.02 | 0.01 |
| λIL | 0.12 | 0.08 | 0.04 | 0.03 | 0.02 | 0.01 | 0.01 |

| QA(g/s) | 5 | 10 | 15 | 20 | 30 | 40 | 50 |
|---|---|---|---|---|---|---|---|
| λIR | 0.15 | 0.1 | 0.07 | 0.05 | 0.03 | 0.02 | 0.01 |
| λIL | 0.15 | 0.1 | 0.06 | 0.02 | 0.02 | 0.01 | 0.01 |

FOR HIGH TEMPERATURE CONTROL

FOR LOW TEMPERATURE CONTROL

FOR NORMAL CONTROL

| SPEED(rpm) \ LOAD(%) | 20 | 30 | 40 | 50 | 60 | 70 | 80 | 90 | 100 |
|---|---|---|---|---|---|---|---|---|---|
| 800 | 66 | 63 | 62 | 60 | 54 | 50 | 43 | 36 | 32 |
| 1200 | 64 | 61 | 60 | 57 | 52 | 46 | 41 | 36 | 30 |
| 1600 | 62 | 59 | 58 | 53 | 48 | 43 | 38 | 32 | 20 |
| 2000 | 60 | 56 | 56 | 50 | 46 | 39 | 36 | 0 | 0 |
| 2400 | 58 | 54 | 54 | 47 | 44 | 36 | 34 | 0 | 0 |
| 2800 | 54 | 51 | 48 | 44 | 38 | 0 | 0 | 0 | 0 |
| 3200 | 50 | 46 | 44 | 39 | 32 | 0 | 0 | 0 | 0 |
| 3600 | 45 | 40 | 36 | 32 | 0 | 0 | 0 | 0 | 0 |
| 4000 | 36 | 31 | 0 | 0 | 0 | 0 | 0 | 0 | 0 |
| 4400 | 0 | 0 | 0 | 0 | 0 | 0 | 0 | 0 | 0 |
| 4800 | 0 | 0 | 0 | 0 | 0 | 0 | 0 | 0 | 0 |
| 5200 | 0 | 0 | 0 | 0 | 0 | 0 | 0 | 0 | 0 |
| 5600 | 0 | 0 | 0 | 0 | 0 | 0 | 0 | 0 | 0 |

EXHAUST GAS PURIFYING SYSTEM FOR INTERNAL COMBUSTION ENGINES

CROSS REFERENCE TO RELATED APPLICATION

This application is based on and incorporates herein by reference Japanese Patent Application No. 2002-121306 filed on Apr. 23, 2002.

FIELD OF THE INVENTION

The present invention relates to an exhaust gas purifying system for an internal combustion engine, which is provided with a heater control device for controlling a heater attached to a sensor for detecting the air/fuel ratio in the exhaust gas of the internal combustion engine.

BACKGROUND OF THE INVENTION

In an exhaust gas purifying system, which is provided with an air/fuel ratio sensor upstream of a catalyst disposed on the exhaust pipe of the internal combustion engine so that the output of the air/fuel ratio sensor may approach a target air/fuel ratio. Moreover, another air/fuel ratio sensor is further disposed downstream of the catalyst so that the target air/fuel ratio upstream of the catalyst may be corrected on the basis of the output of that downstream air/fuel ratio sensor.

However, in this system the output characteristics are varied even at the same air/fuel ratio by the temperature change of a solid electrolyte element (or a sensor element) of the air/fuel ratio sensor. In JP-A-9-127035, for example, therefore, the detection precision is improved by controlling the electric current of a heater for heating the sensor element thereby to make the element temperature of the air/fuel ratio sensor constant. In U.S. Pat. No. 5,263,358, moreover, the detection precision is improved by correcting the sensor output characteristics according to the sensor element temperature of the air/fuel ratio sensor. These technologies can improve the detection precision to the air/fuel ratio but not the detection precision (or reaction) to a specific gas.

SUMMARY OF THE INVENTION

Therefore, the invention contemplates to provide an exhaust gas purifying system for an internal combustion engine, which is enabled to detect a specific gas relatively inexpensively by intentionally changing a detection sensitivity (or reaction) of an air/fuel ratio sensor to the specific gas.

In order to achieve this object, a system of the invention gives an air/fuel ratio detecting sensor made by arranging an electrode at a solid electrolyte element, for detecting the air/fuel ratio in the exhaust gas from the engine, priority in sensitivity to a specific gas in the exhaust gas. In order to change this detection sensitivity to the specific exhaust gas, the temperature of the solid electrolyte element is adjusted. As a result, it is possible to improve the detection characteristic of an exhaust gas component to be reduced or detected.

The system of the invention, moreover, adjusts the temperature of the solid electrolyte element in accordance with the running state of the engine so as to change the detection sensitivity of an air/fuel ratio detecting sensor made by arranging an electrode at the solid electrolyte element, for detecting the air/fuel ratio in the exhaust gas from the engine, to the specific exhaust gas. As a result, it is possible to improve the detection characteristic to the exhaust gas component to be reduced or detected.

BRIEF DESCRIPTION OF THE ACCOMPANYING DRAWINGS

The above and other objects, features and advantages of the present invention will become more apparent from the following detailed description made with reference to the accompanying drawings.

Figures 4, 5A, 5B:
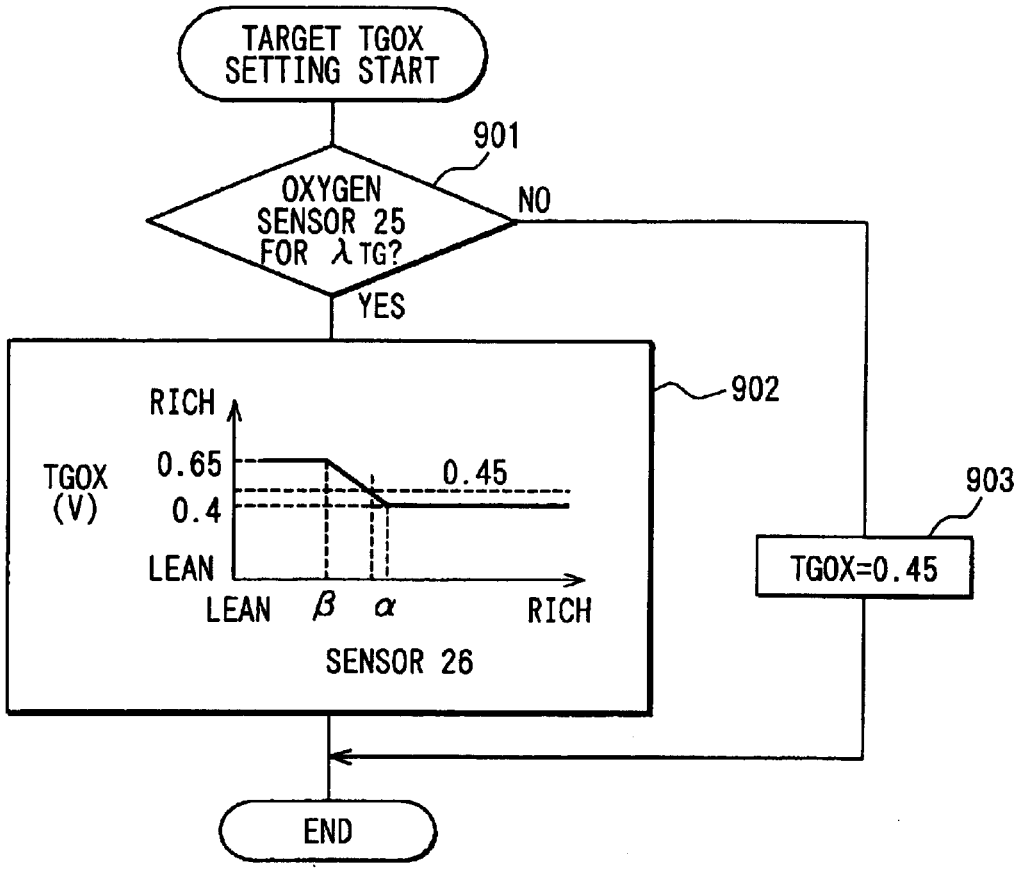
FIG. 4 is a flowchart of a target output voltage routine of a first oxygen sensor in the first embodiment.
Figure 6:
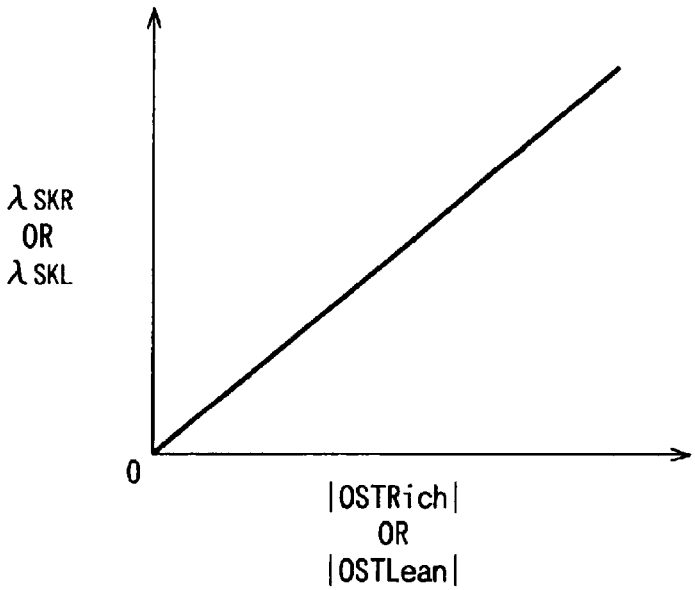
Figure 7:
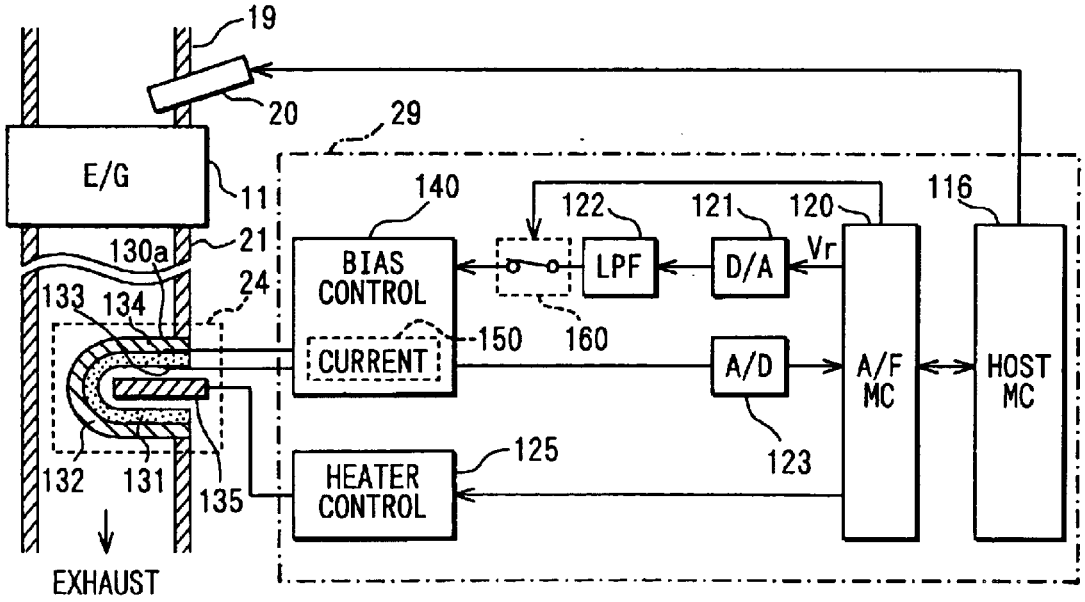
Figure 8:
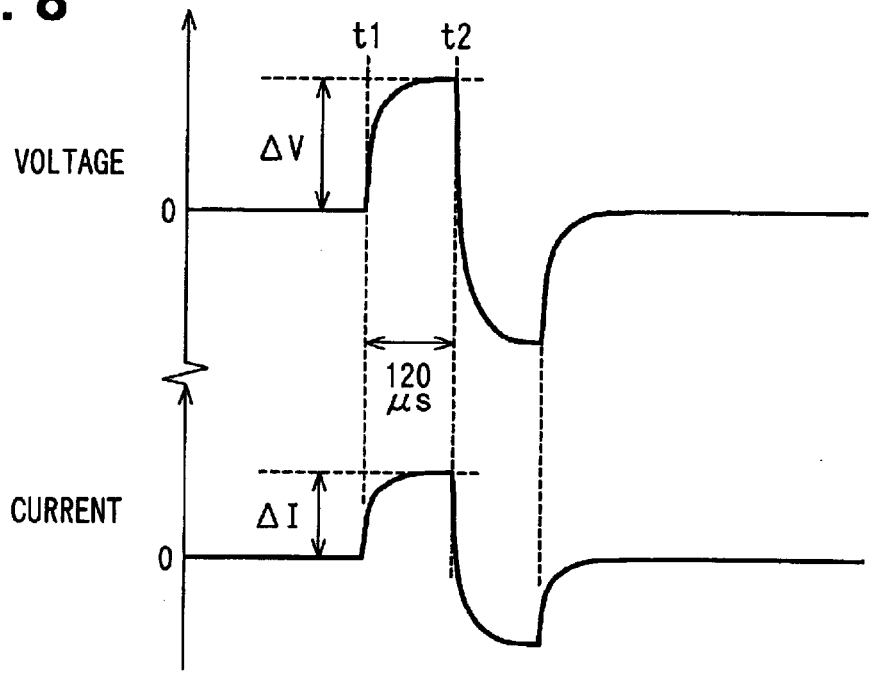
Figure 9:
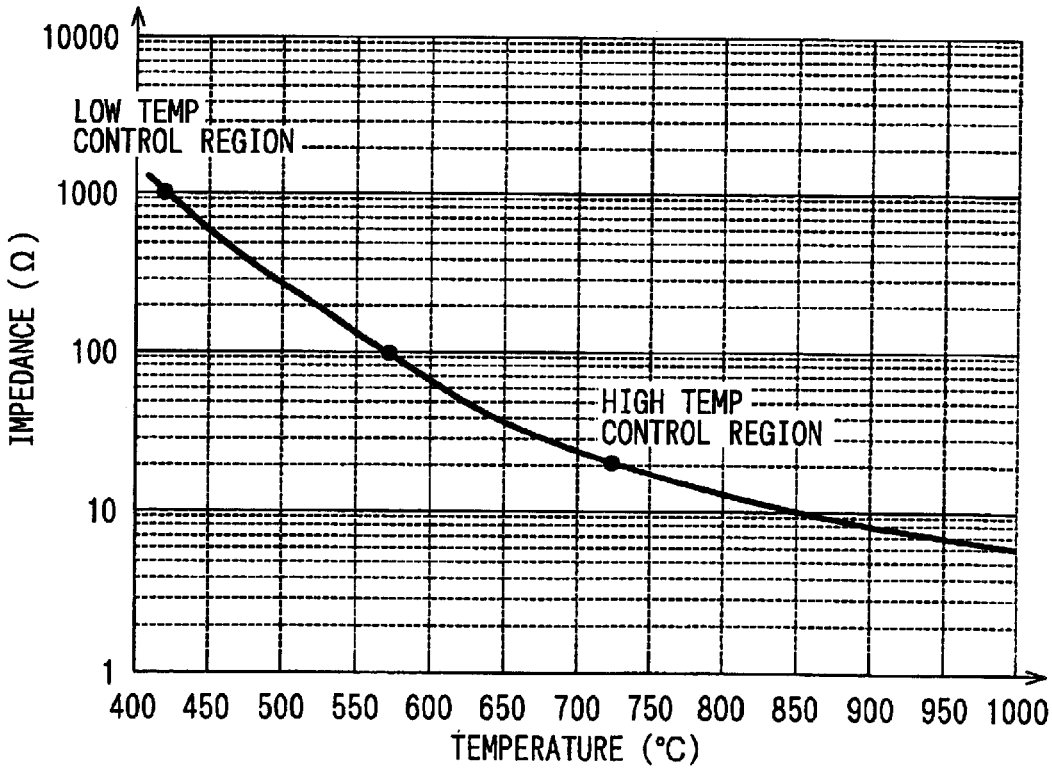
Figure 10:
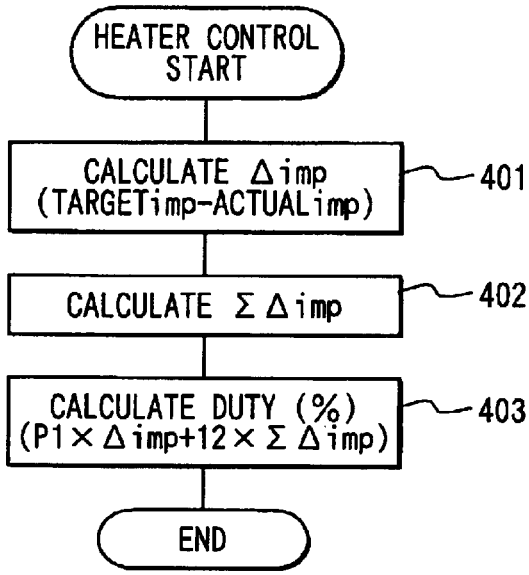
Figure 11:
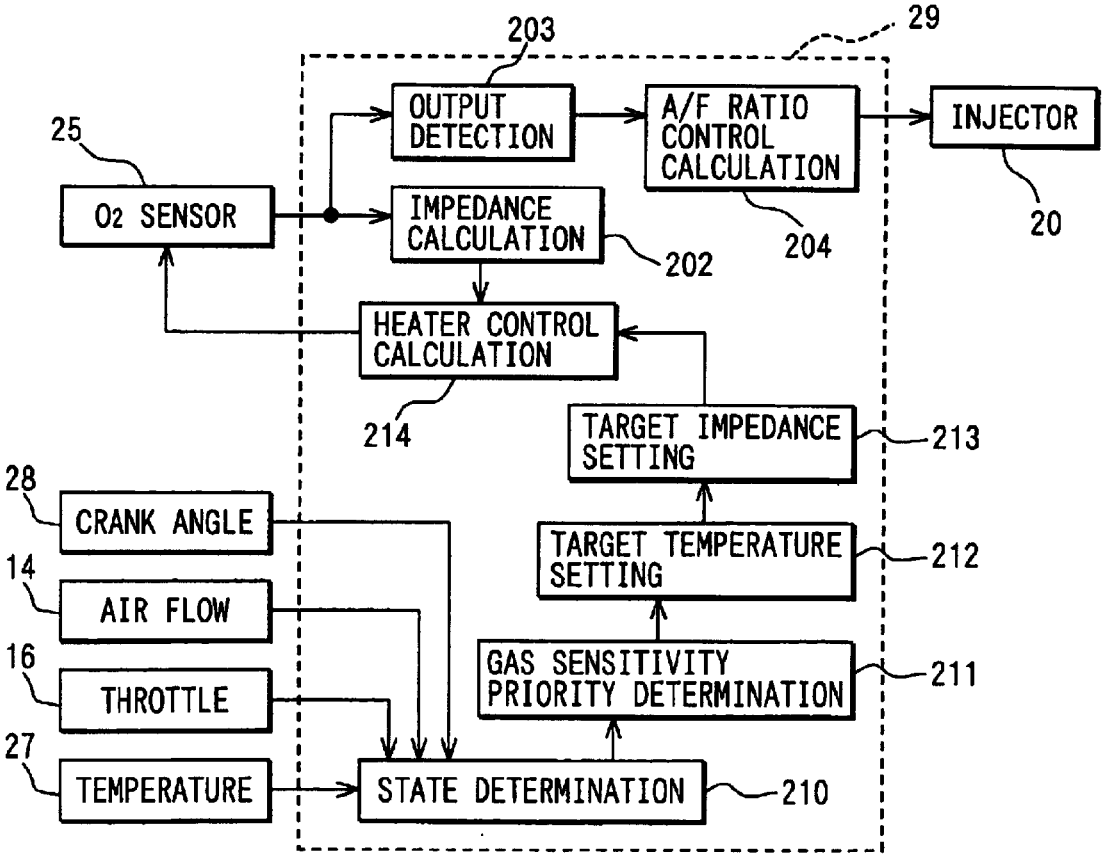
Figure 12:
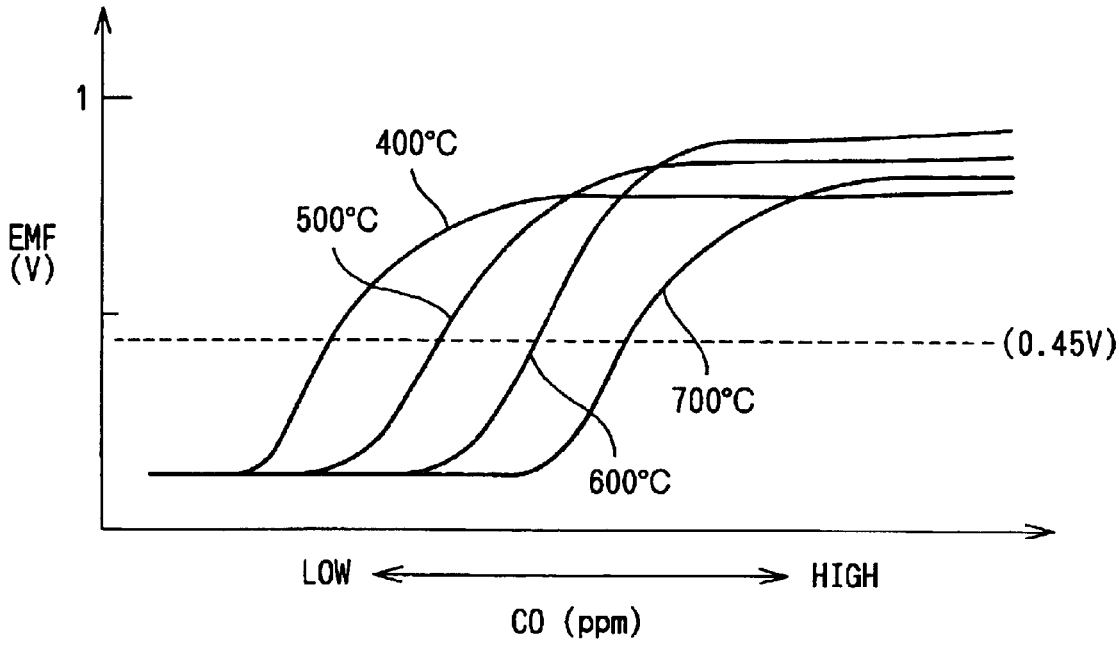
Figure 13:
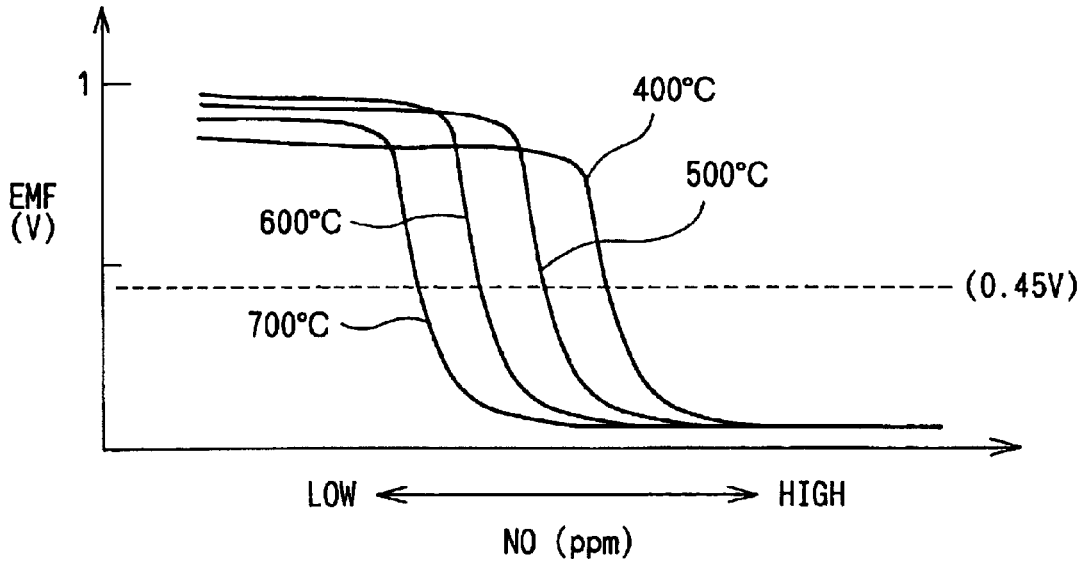
Figure 14:
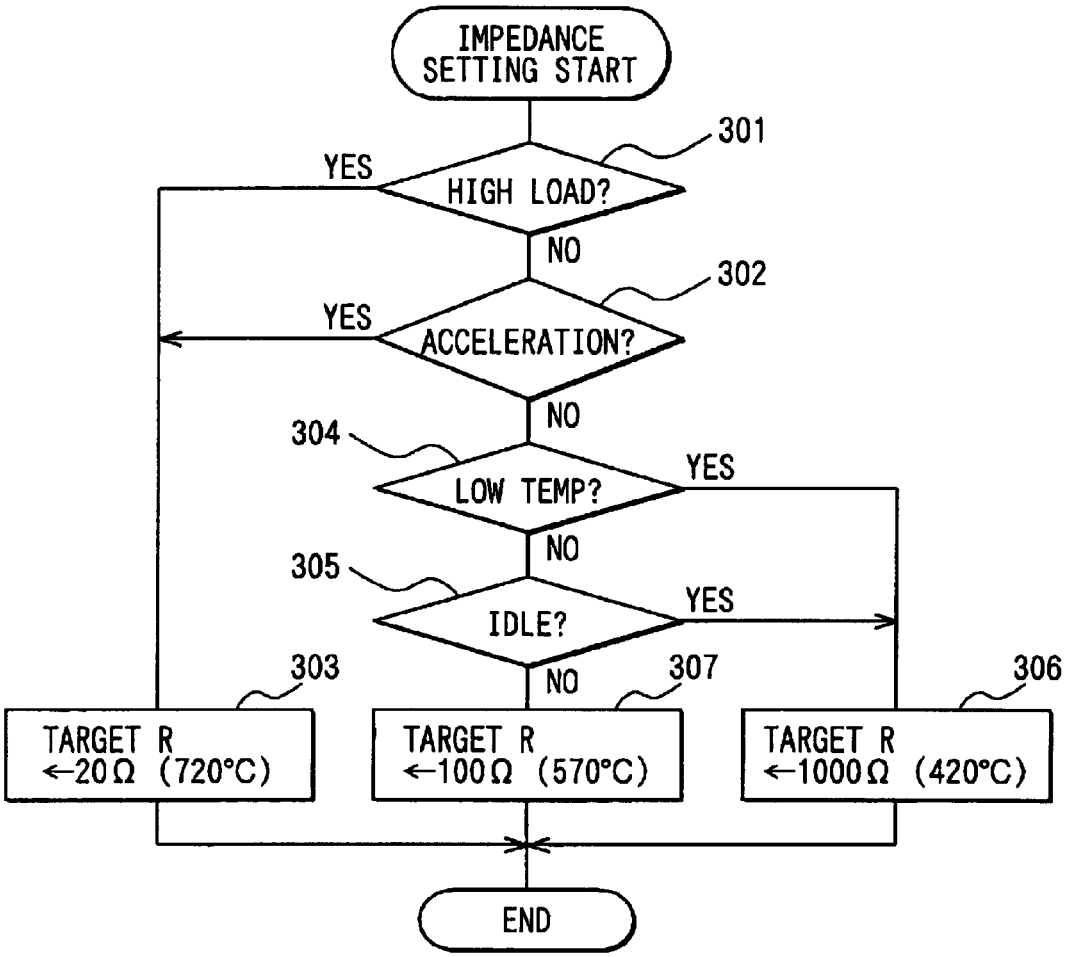
Figures 15, 16:
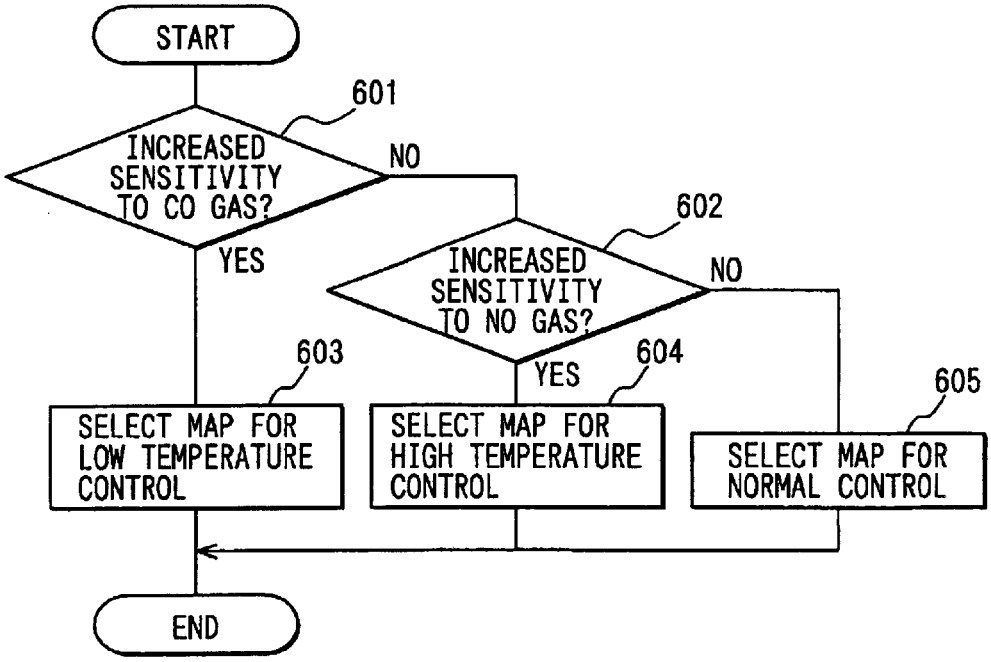
Figure 17:
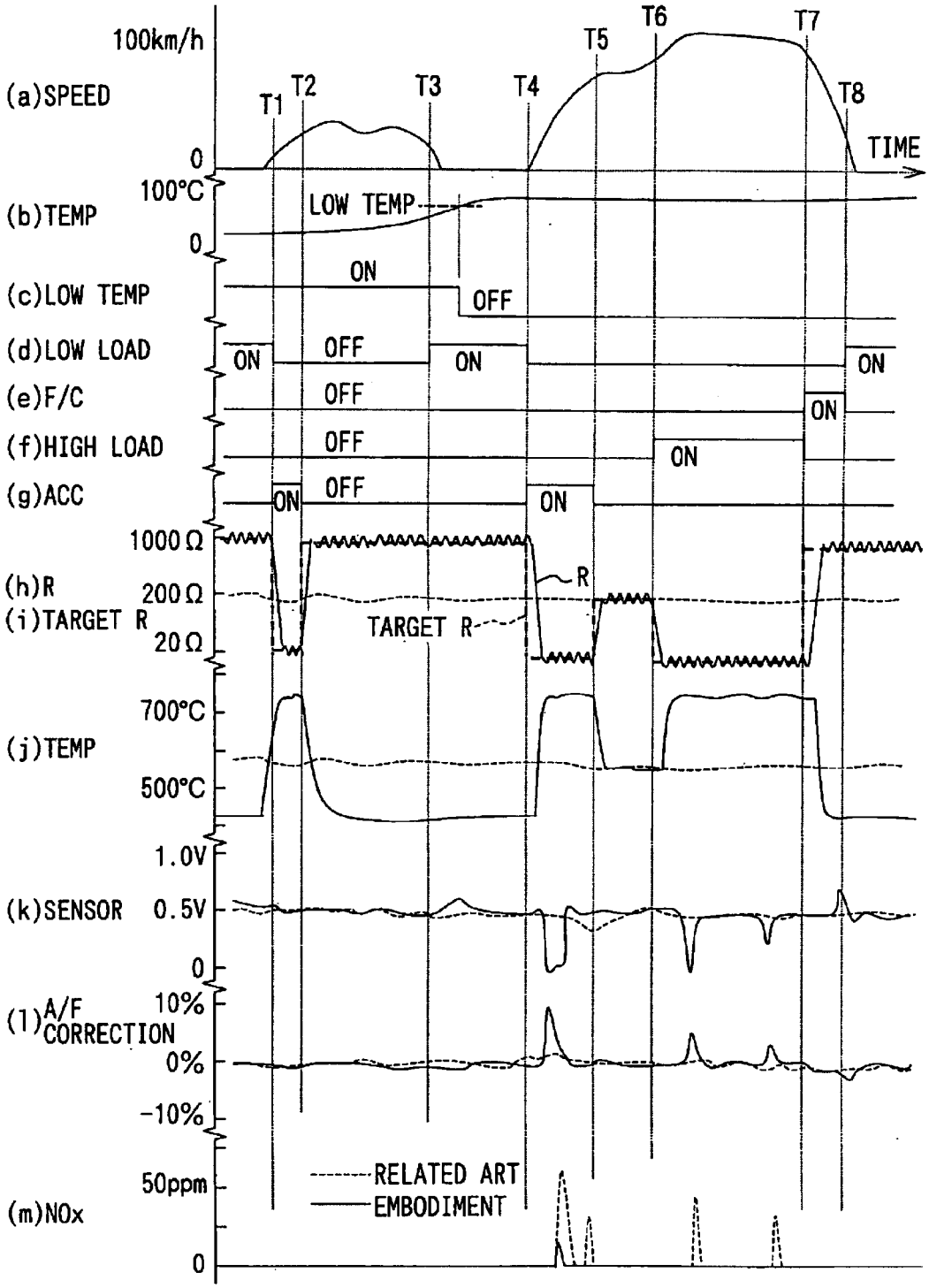
Figure 18:
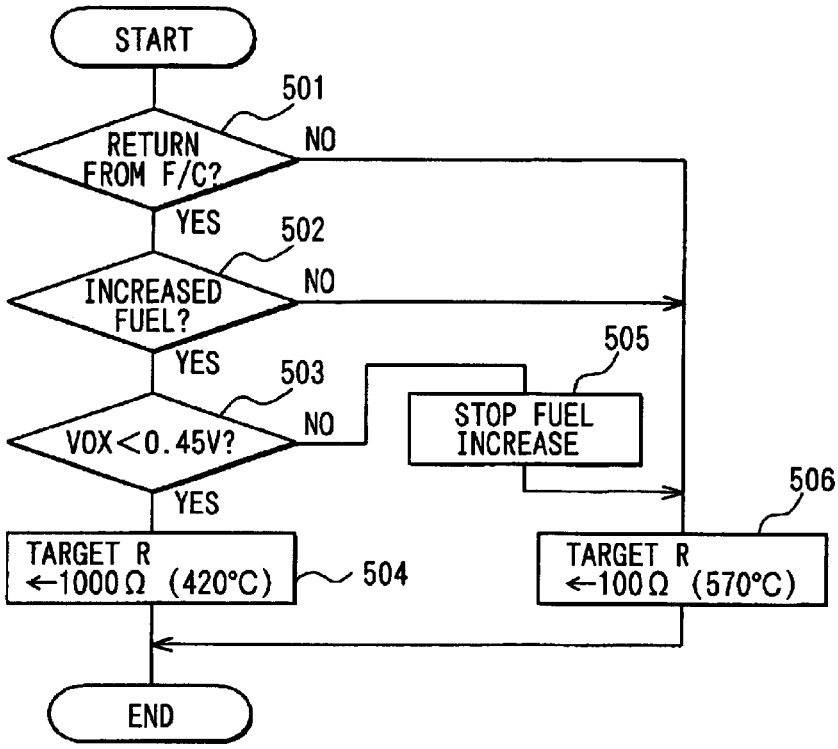
Figure 19:
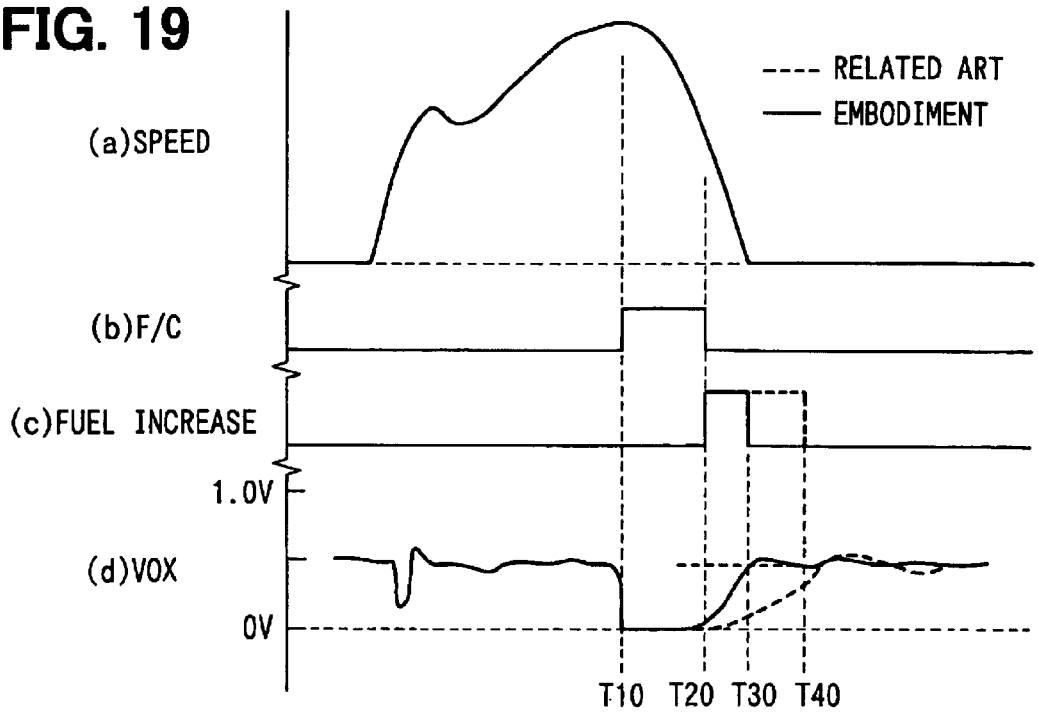

FIGS. 5A and 5B present maps for setting an integrated richness quantity and an integrated leanness quantity in the first embodiment;

FIG. 6 is a map for setting a skip quantity in the first embodiment;

FIG. 7 is a schematic diagram for detecting an air/fuel ratio and impedance;

FIG. 8 is a time chart at the time of detecting the impedance;

FIG. 9 is an impedance characteristic diagram of an oxygen sensor;

FIG. 10 is a flow chart of a heater control of the oxygen sensor of the first embodiment;

FIG. 11 is a block diagram for controlling the element temperature of the oxygen sensor;

FIG. 12 is a CO reaction characteristic diagram of the oxygen sensor;

FIG. 13 is a NO reaction characteristic diagram of the oxygen sensor;

FIG. 14 is a flow chart of a target impedance setting routine in the first embodiment;

FIG. 15 is a map for setting the control duty of a heater;

FIG. 16 is a flow chart of a heater controlling routine in the first embodiment;

FIG. 17 presents time charts of the first embodiment;

FIG. 18 is a flow chart of a target impedance setting routine of a second embodiment of the invention; and FIG. 19 presents time charts of the second embodiment.

DETAILED DESCRIPTION OF THE PREFERRED EMBODIMENT

First Embodiment

First of all, the schematic construction of an engine control system will be described with reference to FIG. 1. An internal combustion engine 11 is provided, at the most upstream portion of its intake pipe 12, with an air cleaner 13 and, on the downstream side of the air cleaner 13, with an air flow meter 14 for detecting the amount of intake air. On the downstream side of this air flow meter 14, there are disposed a throttle valve 15 and a throttle opening sensor 16 for detecting the degree of throttle opening.

On the downstream side of the throttle valve 15, moreover, there is disposed a surge tank 17, which is provided with an intake pipe pressure sensor 18 for detecting an intake pipe pressure. On the other hand, the surge tank 17 is provided with an intake manifold 19 for introducing air into the individual cylinders of the engine 11. In the vicinity of the intake port of each cylinder in the intake manifold 19, there is attached a fuel injection valve 20 for injecting a fuel.

Midway of an exhaust pipe 21 (or an exhaust gas passage) of the engine 11, on the other hand, there are disposed in tandem an upstream catalyst 22 and a downstream catalyst 23 for reducing noxious contents (CO, HC, NOx and so on) in the exhaust gas. In this case, the upstream catalyst 22 is formed to have such a relatively small capacity as is early warmed-up at a start to reduce the exhaust emissions at the start. On the contrary, the downstream catalyst 23 is formed to have such a relatively large capacity as can purify the exhaust gas sufficiently even in a high load range having a high exhaust gas flow rate.

On the upstream side of the upstream catalyst 22, moreover, there is disposed a linear air/fuel ratio sensor 24 for outputting a linear air/fuel ratio signal according to the air/fuel ratio of the exhaust gas. On the downstream side of the upstream catalyst 22 and on the downstream side of the downstream catalyst 23, respectively, there are disposed a first oxygen sensor 25 and a second oxygen sensor 26 having the well-known step-change characteristics (Z-characteristics), in which their individual outputs change relatively abruptly in the vicinity of the stoichiometric air/fuel ratio. The linear air/fuel ratio sensor and the oxygen sensor will be referred to as the air/fuel ratio sensor. To the cylinder block of the engine 11, moreover, there are attached a cooling water temperature sensor 27 for detecting the cooling water temperature and a crank angle sensor 28 for detecting the engine speed NE.

The outputs of these various sensors are inputted to an engine control unit (ECU) 29. This ECU 29 is constructed mainly of a microcomputer, and feedback-controls the air/fuel ratio of the exhaust gas, for example, by executing a program stored in its internal ROM (or storage medium).

Figure 2:
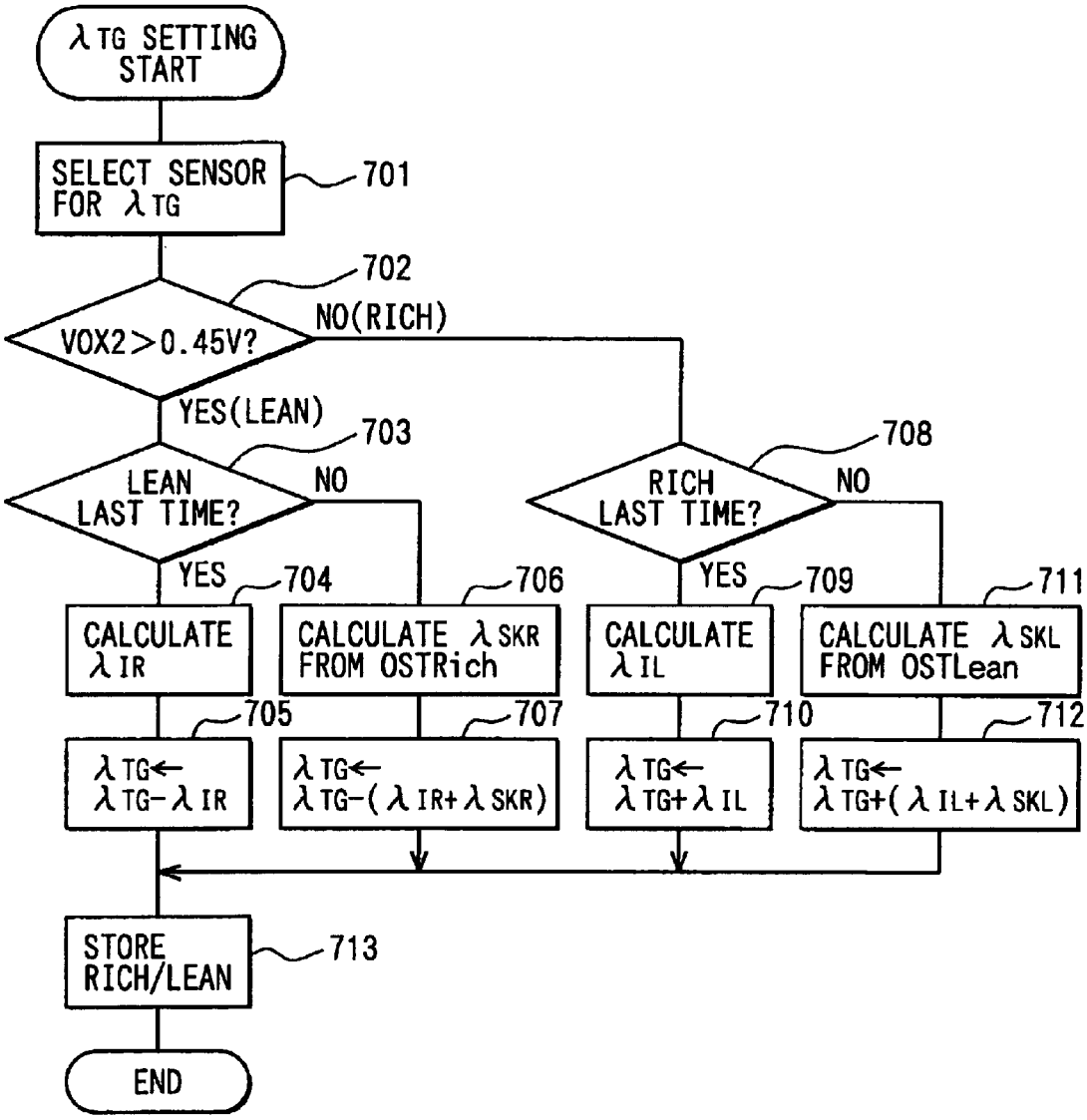
FIG. 2 is a flow chart of a target air/fuel ratio setting routine of a first embodiment of the invention.

FIG. 2 is a flow chart of an air/fuel ratio feedback control at the time when the linear air/fuel ratio sensor 24 is used as an air/fuel ratio sensor on the upstream side of the catalyst whereas the first oxygen sensor 25 and the second air/fuel ratio sensor 26 are interchanged and used as the air/fuel ratio sensor on the downstream side of the catalyst.

Figure 1:
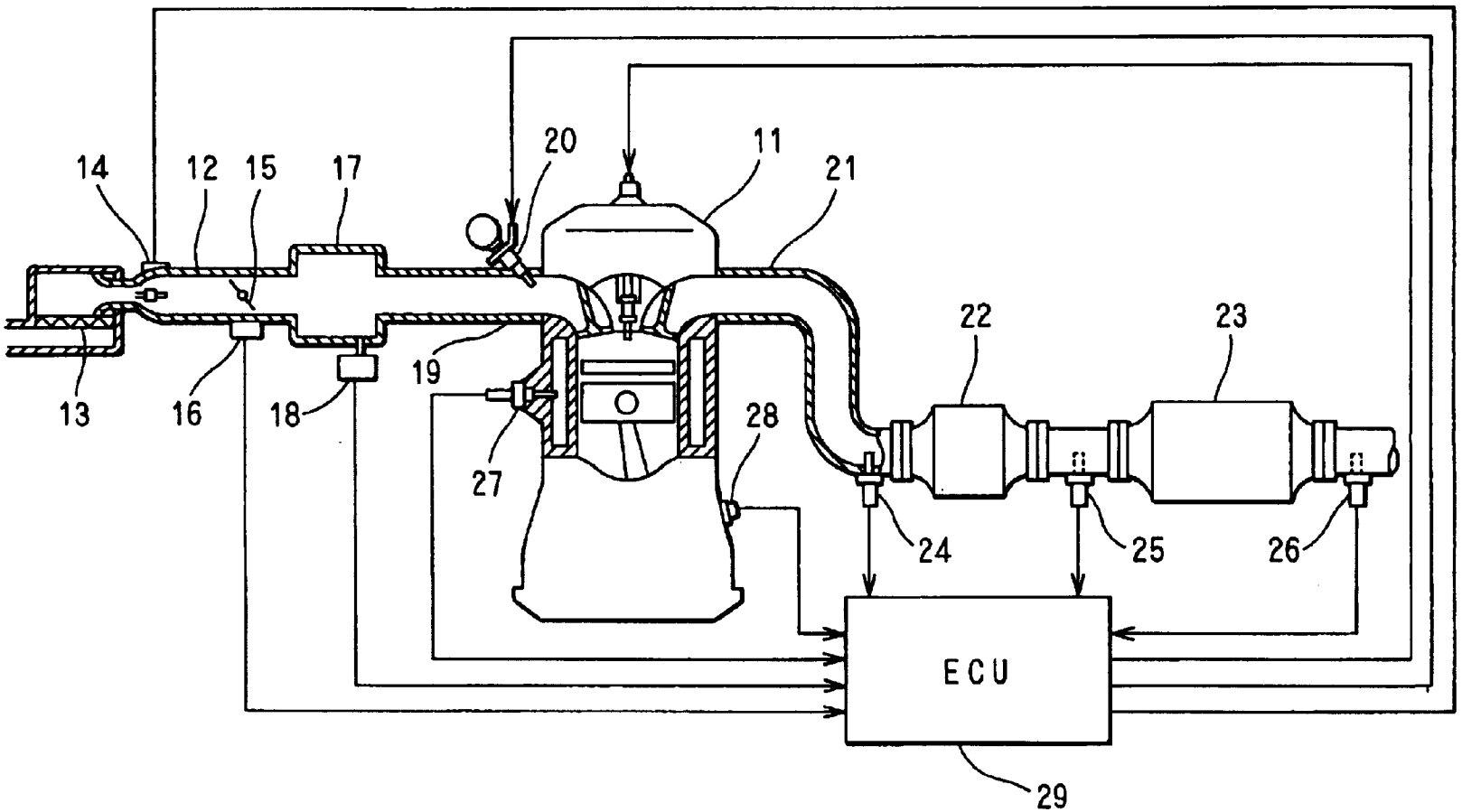
FIG. 1 is a schematic diagram of an exhaust purifying system of the invention.
Figure 3:
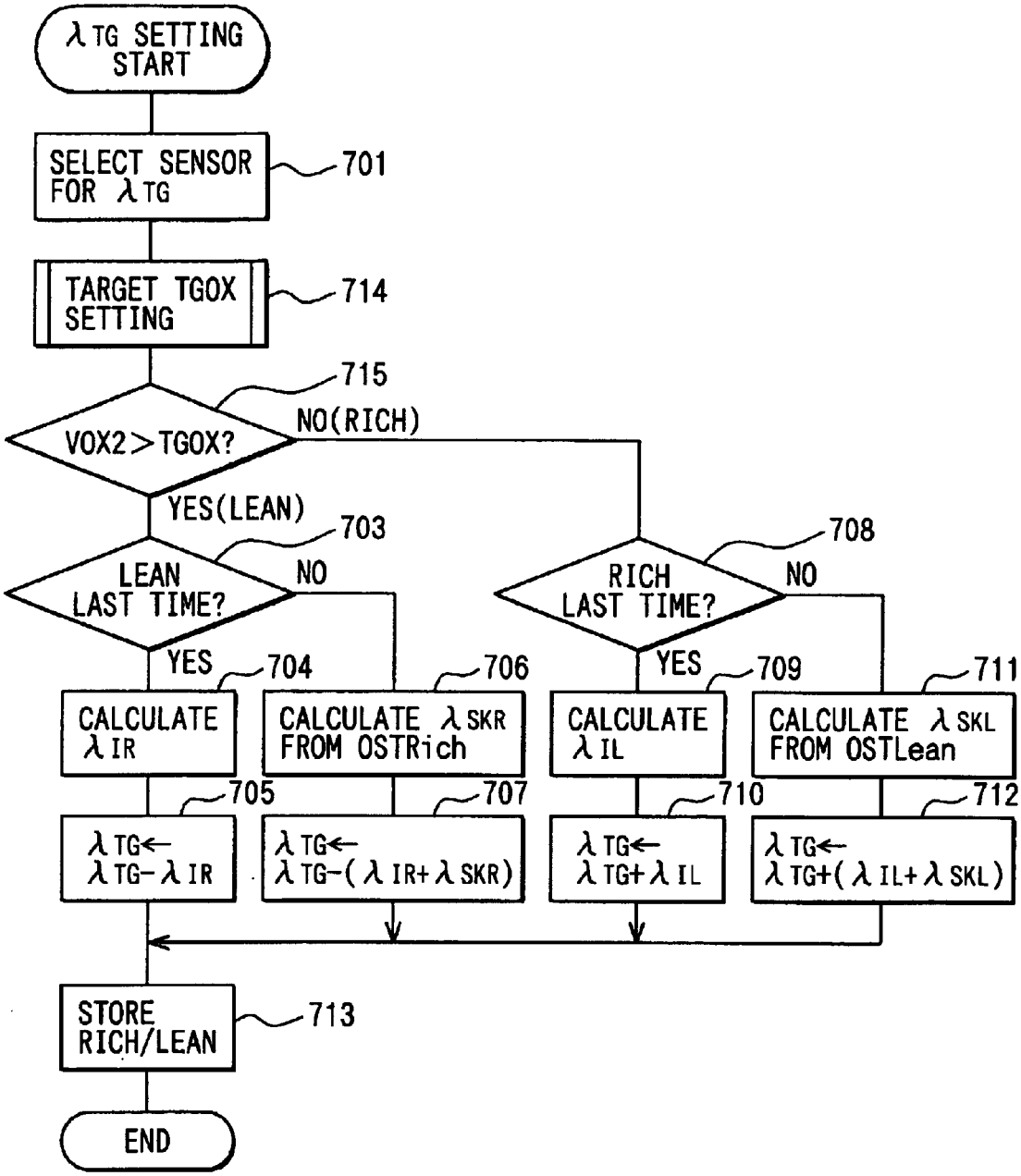
FIG. 3 is a flow chart of a target air/fuel ratio setting routine of a modification of the first embodiment.

On the other hand, FIG. 3 and FIG. 4 are flow charts of another air/fuel ratio feedback control of the case in which the second oxygen sensor 26 is used in addition to the linear air/fuel ratio sensor 24 and the first oxygen sensor 25 of FIG. 1.

Referring first to FIG. 2, when this program is started, at first step 701, the downstream side oxygen sensor to be used for setting a target air/fuel ratio λTG is selected from the first oxygen sensor 25 and the second oxygen sensor 26.

At a low load running time of a low exhaust gas flow, for example, the exhaust gas can be considerably purified with only the upstream catalyst 22. Therefore, a better response to the air/fuel ratio control can be obtained by using the first oxygen sensor 25 as the downstream sensor to be used for setting the target air/fuel ratio λTG. As the exhaust gas flow rate becomes higher, however, the more exhaust gas component passes without being purified in the upstream catalyst 22. It is, therefore, necessary to purify the exhaust gas by using both the upstream catalyst 22 and the downstream catalyst 23 effectively. In this case, it is preferable to make the air/fuel ratio feedback control considering the state of the downstream catalyst 23, too. It is, therefore, preferable to use the second oxygen sensor 26 as the downstream sensor to be used for setting the target air/fuel ratio λTG.

As there becomes the shorter the delay time for the change in the air/fuel ratio of the exhaust gas discharged from the engine 11 (or the output change in the air/fuel ratio sensor 24 on the upstream side of the upstream catalyst 22) to appear in the output change of the first oxygen sensor 25, on the other hand, it is meant that the more exhaust gas component passes without being purified in the upstream catalyst 22 (or the purification efficiency degrades the lower). In case the delay time of the output change of the first oxygen sensor 25 is short, therefore, it is preferable to use the output of the second oxygen sensor 26 as the downstream sensor to be used for setting the target air/fuel ratio λTG.

Therefore, the condition for selecting the second oxygen sensor 26 as the downstream sensor to be used for setting the target air/fuel ratio λTG is: (1) that the delay time (or period) for the air/fuel ratio change of the exhaust gas discharged from the engine 11 (or the output change of the linear air/fuel ratio sensor 24) to appear in the output change of the first oxygen sensor 25 is shorter than a predetermined time (or predetermined period); or (2) that the intake air flow rate (or the exhaust gas flow rate) is no less than a predetermined value.

The second oxygen sensor 26 is selected, if one of those two conditions (1) and (2) is satisfied, and the first oxygen sensor 25 is selected, if neither of them is satisfied. Here, it is arbitrary to select the second oxygen sensor 26, if both the conditions (1) and (2) are satisfied.

After the downstream sensor to be used for setting the target air/fuel ratio λTG is thus selected, the routine advances to step 702, at which whether the air/fuel ratio is rich or lean is determined depending upon whether the output voltage VOX2 of the selected oxygen sensor is higher or lower than the target output voltage (e.g., 0.45 V), which corresponds to the stoichiometric air/fuel ratio (λ=1). If lean, the routine advances to step 703, at which it is determined whether or not the air/fuel ratio was also lean at the last time. If lean not only last time but also at this time, the routine advances to step 704, at which an integrated richness quantity λIR is calculated from the map in accordance with the present intake air flow QA.

As the map for this integrated richness quantity λIR, there are stored a map, as tabulated in the upper row of FIG. 5A, for the upstream catalyst downstream sensor (or the first oxygen sensor), and a map, as tabulated in the upper row of FIG. 5B, for the downstream catalyst downstream sensor (or the second oxygen sensor), so that one of the maps is selected according to the sensor employed.

These map characteristics of the integrated richness value λIR are set such that the integrated richness value λIR is smaller for the higher intake air flow QA, and are set in the region of a low intake air flow QA such that the map for the downstream catalyst downstream sensor has a slightly larger integrated richness value λIR than the map for the upstream catalyst downstream sensor. After the integrated richness value λIR is calculated, the routine advances to step 705, at which the target air/fuel ratio λTG is corrected by λIR to the richer side, and this program is ended by storing the richness/leanness at this time (at step 713).

In case the air/fuel ratio turns lean from the rich condition of the last time, on the other hand, the routine advances from step 703 (NO) to step 706, at which a skip (proportional) quantity λSKR to the rich side is calculated according to a rich component storage OSTRich of the catalyst. Here, the calculation of the rich component storage OSTRich is known (for instance, JP-A-2001-193521).

The map characteristics of FIG. 6 are so set that the rich skip quantity λSKR may be the smaller as the absolute value of the rich component storage OSTRich becomes the less.

After the skip quantity λSKR was calculated, the routine advances to step 707, at which the target air/fuel ratio λTG is corrected by λXIR+λSKR to the rich side, and this program is ended by storing the richness/leanness at this time (at step 713).

If it is determined at step 702 that the output voltage VOX2 of the oxygen sensor is rich, on the other hand, the routine advances to step 708, at which it is determined whether or not the air/fuel ratio was also rich last time. If the air/fuel ratio was rich at the last time and at this time, the routine advances to step 709, at which an integrated leanness value λIL is determined from the map shown in FIG. 5 in accordance with this intake air flow QA. As the map for this integrated leanness quantity λIL, there are set a map, as tabulated in the lower row of FIG. 5A, for the upstream catalyst downstream sensor (or the first oxygen sensor), and a map, as tabulated in the lower row of FIG. 5B, for the downstream catalyst downstream sensor (or the second oxygen sensor), so that one of the maps is selected according to the sensor selected as the downstream sensor.

The map characteristics of the integrated leanness value λIL of FIG. 5A and FIG. 5B are set such that the integrated leanness value λIL is smaller for the higher intake air flow QA, and are set in the region of a low intake air flow QA such that the map for the downstream catalyst downstream sensor has a slightly larger integrated leanness value λIL than the map for the upstream catalyst downstream sensor. After the integrated leanness value λIL is calculated, the routine advances to step 710, at which the target air/fuel ratio λTG is corrected by λIL to a leaner side, and this program is ended by storing the richness/leanness at this time (at step 713).

In case the air/fuel ratio turns rich from the lean condition of the last time, on the other hand, the routine advances from step 708 (NO) to step 711, at which a proportional (ski) quantity λSKL to the lean side is determined from the map shown in FIG. 6 according to a lean component storage OSTLean of the catalyst. Here, the calculation of the lean component storage OSTLean is known (for instance JP-A-2001-193521).

The map characteristics of FIG. 6 are so set that the lean skip quantity λSKR may be smaller as the absolute value of the lean component storage OSTLean becomes less. After this, at step 712, the target air/fuel ratio λTG is corrected by λIL+λSKL to the lean side, and this program is ended by storing the richness/leanness at this time (at step 713).

When the rich component storage OSTRich or the lean component storage OSTLean is lowered by the degradation of the catalysts 22 and 23, as apparent from the map of FIG. 6, the rich skip quantity λSKR and the lean skip quantity λSKL are gradually set to lower values. Therefore, excessive corrections over the adsorption limits of the catalysts 22 and 23 are made to prevent the noxious contents in advance from being discharged.

Another example for setting the target air/fuel ratio is shown in FIG. 3 and FIG. 4.

The ECU 29 executes the target air/fuel ratio setting program of FIG. 3 and the target output voltage setting program of FIG. 4 thereby to change the target output voltage TGOX of the first oxygen sensor 25 according to the output of the second oxygen sensor 26 when the first oxygen sensor 25 is selected as the downstream sensor to be used for setting the target air/fuel ratio λTG of the air/fuel ratio feedback control.

Here in FIG. 3, the steps of executing the operations similar to those of FIG. 2. The following description is given mainly on the points different from those of FIG. 2.

In the target air/fuel ratio setting program of FIG. 3, at the first step 701, the downstream sensor to be used for setting the target air/fuel ratio λTG is selected from the oxygen sensor 25 on the downstream side of the upstream catalyst 22 and the oxygen sensor 26 on the downstream side of the downstream catalyst 23. After this, the routine advances to step 714, at which the target output voltage setting program of FIG. 4 is executed to set the target output voltage TGOX of the downstream sensor to be used for setting the target air/fuel ratio λTG.

After this, the routine advances to step 715, at which whether the air/fuel ratio is rich or lean is determined depending on whether the output voltage VOX2 of the oxygen sensor selected is higher or lower than the target output voltage TGOX. According to this determination result, the target air/fuel ratio λTG is calculated at steps 703 to 713 by the above method, and this program is ended by storing the richness/leanness at this time.

In the target output voltage setting program of FIG. 4 to be executed at step 714 of FIG. 3, at first step 901, it is determined whether or not the first oxygen sensor 25 is selected as the downstream sensor to be used for setting the target air/fuel ratio λTG. If the first oxygen sensor 25 is selected as the downstream sensor to be used for setting the target air/fuel ratio λTG, the routine advances to step 902, at which the target output voltage TGOX according to the present output voltage of the second oxygen sensor 26 is calculated from the map, in which the target output voltage TGOX is plotted against the output voltage of the second oxygen sensor 26 as a parameter.

In this case, the map of the target output voltage TGOX is set as follows. Within a predetermined range (β≦output voltage≦α) in which the output voltage (or the air/fuel ratio of the outflow gas of the downstream catalyst 23) of the second oxygen sensor 26 is in the neighborhood of the stoichiometric air/fuel ratio, the target output voltage TGOX becomes the lower (or the leaner) as the output of the second oxygen sensor 26 becomes the higher (or the richer).

The map is also set as follows. Within a region in which the output of the second oxygen sensor 26 is higher than the predetermined value α, moreover, the target output voltage TGOX takes a predetermined lower limit (e.g., 0.4 V). Within a region in which the output of the second oxygen sensor 26 is lower than the predetermined value β, the target output voltage TGOX takes an upper limit (e.g., 0.65 V).

As a result, the target output voltage TGOX of the first oxygen sensor 25 is set either within a range, in which the adsorption of the exhaust gas component of the downstream catalyst 23 is no more than a predetermined value or within a range, in which the air/fuel ratio of the exhaust gas to flow through the downstream catalyst 23 is within that of a predetermined purified wind.

In case the second oxygen sensor 26 is selected as the downstream sensor to be used for setting the target air/fuel ratio λTG, on the other hand, the routine advances from step 901 to step 903, at which the target output voltage TGOX is set at a predetermined value (e.g., 0.45 V). The above target output voltage setting program performs a second feedback control.

As shown in FIG. 7, the ECU 29 is provided with a microcomputer (MC) 120. This microcomputer 120 is connected with a host microcomputer 116 for realizing a fuel injection control, an ignition control and so on. The linear air/fuel ratio sensor 24 is mounted on the exhaust pipe 21 extending from the body of the engine 11, and its output is detected by the microcomputer 120. This microcomputer 120 is constructed of the well-known CPU, ROM, RAM, backup RAM and so on for executing various operations, and controls a heater control circuit 125 and a bias control circuit 140 in accordance with a predetermined control program.

Here, a bias command signal Vr, as outputted from the microcomputer 120, is inputted through a D/A converter 121 to the bias control circuit 140. Moreover, the output, as corresponding to the air/fuel ratio (or oxygen concentration) at times, of the linear air/fuel ratio sensor 24 is detected, and the detected value is inputted through an A/D converter 123 to the microcomputer 120. Still moreover, the heater voltage and the heater current are detected by the heater control circuit 125, and the detected values are inputted through the A/D converter 123 to the microcomputer 120.

On the other hand, the predetermined bias command signal Vr is applied to an element, and changes between predetermined times t1 and t2, as shown in FIG. 8, that is, an element voltage ΔV and an element current ΔI are detected to detect the element impedance R from the following formula:

$$\text{Impedance } R=\Delta V/\Delta I.$$

The detected element impedance value is inputted to the microcomputer 120. The element impedance has such an intense correlation to the element temperature, as shown in FIG. 9, so that the element temperature of the air/fuel ratio sensor can be controlled by duty-controlling the heater belonging to the air/fuel ratio sensor thereby to set the element impedance to a predetermined value.

For the first oxygen sensor 25 and the second oxygen sensor 26, too, the element impedances are likewise detected, and the element temperatures of the oxygen sensors can be controlled by duty-controlling the heaters belonging to the first and second oxygen sensors 25 and 26 so that the element impedances may take predetermined values.

As shown in FIG. 10, this embodiment adopts a method, in which the PI (Proportional and Integral) control is made with the deviation between the element impedance actually detected and the target impedance calculated with the target element temperature, so that the element temperature of the first oxygen sensor 25 is controlled by the method.

This detail will be described with reference to the flow chart of FIG. 10. In this flow chart, the program is processed at a predetermined timing. At first step 401, there is calculated a deviation (Δimp) between the target impedance calculated from the target element temperature and the actual element impedance detected by the element impedance detecting circuit. At step 402, there is calculated an integrated value (ΣΔimp) of the impedance deviation for executing the integral control. At step 403, the heater duty is calculated from the following formula by using the deviation, the integrated value, a proportional coefficient P1 and an integral coefficient I2.

$$\text{Heater Duty } (\%)=P1\times\Delta imp+I2\times\Sigma\Delta imp.$$

The heater duty thus calculated is inputted to the heater control circuit, as designated at 125 in FIG. 7, so that the heater control of the first oxygen sensor 25 is made.

Here, the heater duty is the adjusted calorific value for controlling the temperature of the oxygen sensor element and is based on the electric power (W). For a constant temperature, it is desired to control the electric power to a constant value. In case the temperature is controlled by the heater duty, a correction is made to the reference voltage (e.g., 13.5 V), i.e., the electric power×$(13.5/\text{voltage})^2$ so that the temperature may be prevented from being changed with the voltage supplied.

In FIG. 7, the linear air/fuel ratio sensor 24 is mounted to protrude into the exhaust pipe 21 and is constructed mainly of a cover 132, a sensor body 131 and a heater 135. The cover 132 is formed into such a C-shaped section as has a number of pores in its peripheral wall for providing the communication between the inside and outside of the cover 132. The sensor body 131 acting as the sensor element portion generates a voltage corresponding to either the oxygen concentration in the lean air/fuel ratio region or the concentration of the unburned gas (e.g., CO, HC and $H_2$) in the rich air/fuel ratio region.

The heater 135 is housed in the atmospheric side electrode layer and heats the sensor body 131 (having an atmospheric side electrode layer 133, a solid electrolyte layer 131 and an exhaust gas side electrode layer 134) with its calorific energy. The heater 135 has a sufficient calorific capacity for activating the sensor body 131. Moreover, the first oxygen sensor 25 and the second oxygen sensor 26 also have the similar constructions.

Here, the laminated type air/fuel ratio sensor having an integral structure of an element and a heater so as to improve the heater performance has been proposed in recent years. The invention can be applied not only to such sensor but also to any kind of air/fuel ratio sensor, if the sensor has electrodes arranged on a solid electrolyte element.

The control operation of the first embodiment will be described with reference to the system block diagram shown in FIG. 11. It is assumed here that the invention is applied to the first oxygen sensor 25 arranged just downstream of the upstream catalyst of FIG. 1.

The output of the exhaust gas component (e.g., the rich gas or the lean gas) discharged from the engine 11 by the first oxygen sensor (or the air/fuel ratio sensor) 25 is detected by an output detecting circuit 203 of the ECU 29, and the air/fuel ratio (λ or A/F) control quantity is calculated by an air/fuel ratio control quantity calculating block 204. Here, the variation of the fuel injection rate (quantity) is determined by comparing the target voltage and the detected voltage. The fuel injection rate determined as the air/fuel ratio control quantity is fed to the injector 20 so that the fuel is injected in the desired rate.

As described with reference to FIG. 7 and FIG. 8, an impedance calculating block 202 calculates the element impedance, and a heater control quantity calculating block 214 calculates the heater control quantity with a deviation from the target impedance set by a target impedance setting block 213, so that the heater is controlled to set the temperature of the sensor element of the first oxygen sensor 25 to a desired value.

Here, the target impedance is calculated by the following procedure. The determination of the running state is executed in a running state determining block 210 with the pieces of information indicating the running state of the engine and coming from the crank angle sensor 28, the air flow meter 14, the throttle opening sensor 16, the cooling water temperature sensor 27 and so on. On the basis of this running state determination, a specific gas sensitivity priority determining block 211 determines whether the composition of the exhaust gas discharged from the engine under the running condition prevailing or just after is mainly the rich gas or the lean gas.

In case the specific gas sensitivity priority determining block 211 determines that the lean gas is major in the state where the NOx is easily produced as in a high load or at an acceleration, a target element temperature setting block 212 sets the target element temperature to 720° C., for example, so that the oxygen sensor element temperature may rise to improve the lean gas reactivity. In case the specific gas sensitivity priority determining block 211 determines that the rich gas is (or will be) major in the state where the HC or CO is easily produced as at a low temperature, in a low load or at a deceleration, on the contrary, the target element temperature setting block 212 sets the target element temperature to 420° C., for example, so that the oxygen sensor element temperature may fall to improve the rich gas reactivity.

The reactivity of the rich and lean gases of the oxygen sensors will be described with reference to the characteristic diagrams of FIG. 12 and FIG. 13.

FIG. 12 shows the reactivity of $O_2$ sensor to carbon monoxide (CO) in nitrogen ($N_2$) as an electromotive force (emf) of the sensor. As shown, the reactivity is high to minute CO at a low element temperature, but the reactivity to a low concentration of CO falls as the element temperature rises. This is because the reactivity at the $O_2$ sensor electrode to CO has temperature characteristics so that the following reactions at a low element temperature are promoted to deprive $O_2$:

$$\text{CO (Adsorption)}+\tfrac{1}{2}O^{2-}\text{ (Adsorption)} \Leftrightarrow CO_2+2e^-.$$

On the other hand, FIG. 13 shows the reactivity of the $O_2$ sensor of the case in which nitrogen monoxide (NO) is introduced into an atmosphere of nitrogen ($N_2$) and carbon monoxide (CO). As shown, the $O_2$ sensor reacts with fine NO in an element high temperature state but less with a low concentration of NO as the element temperature becomes lower. This is because the following reactions occur on the $O_2$ sensor electrode surface and the electrode so that the combustion with the rich gas (CO) and the decomposition of NO at the electrode are more promoted in a high temperature region than in a low temperature region thereby to lower the electromotive force on the low concentration side:

$$CO+NO \rightarrow CO_2+N_2, \text{ and}$$

$$2NO+4e \rightarrow N_2+2O^{2-}.$$

On the basis of the target temperature set by the target element temperature setting block 212 of FIG. 11, the target impedance setting block 213 sets the target impedance with the relations, as shown in FIG. 15, between the element impedance and the element temperature. The heater control quantity calculating block 214 determines the heater control quantity by the comparison with the detected element impedance value.

This control operation will be described with reference to the flow chart of FIG. 14. This routine is started at a predetermined timing such as a time or an injection synchronization, and it is determined at steps 301 and 302 whether or not the lean gas is major in the running state. Specifically, it is determined at step 301 whether or not the running state is under a high load (or a high air flow region). It is determined at step 302 whether or not the drive is at an acceleration. In the case of the high load running time and/or the acceleration, it is determined that the lean gas is major in the running state.

In case it is determined at step 301 and step 302 that the lean gas is major, the routine advances to step 303, at which the target impedance is set to 20 Ω for a high element temperature (e.g., 720° C.). In case it is determined that the lean gas is not major (namely, in case the determinations of the two steps are No), on the contrary, the routine advances to steps 304 and 305, at which it is determined whether or not the discharge of rich gas such as HC or CO is major in the running condition.

Specifically, it is determined at step 304 whether or not the engine temperature is low, and it is determined at step 305 whether or not the running condition is idle or light load. In case the engine temperature is low and in case the running condition is idle and light load, it is determined that the rich gas is major.

In case it is thus determined at step 304 and step 305 that the rich gas is major (in case the answers are YES), the routine advances to step 306, at which the target impedance is set to 1,000 Ω for a low element temperature (e.g., 420° C.).

In case the answers of all steps 301, 302, 304 and 305 are No, the target impedance is set to 100 Ω at step 307 for the normal target temperature (e.g., 570° C.).

The $O_2$ sensor control to be executed for the target impedances thus set can be achieved by the method thus far described. Moreover, the control achieving method proposed herein need not be the heater control for calculating the element impedance but may be the well-known heater control without calculating the element impedance. The invention can also be applied to the case in which the control is made on the basis of the heater control quantity (in the duty or electric power) set under each predetermined engine running condition.

An example of this application will be described with reference to FIG. 15 and FIG. 16.

FIG. 15 shows a control map for setting the heater duty on the basis of the engine speed and the engine load. The fundamental controlling heater duty map of FIG. 15 is a map to be used at normal time. In this embodiment, not only the normal map but also a low temperature controlling heater duty map and a high temperature controller heater duty map are provided in correspondence with a demand for detecting the gas composition of the engine. These maps are interchanged for use according to the running state or the like.

With these maps, the invention can be embodied in the system, which merely selects the heater duty map to be used from the target element temperature results set by the target element temperature setting block 212 of FIG. 11 but does not calculate the element impedance.

Here, the element high temperature controlling heater duty map has a high value (in the duty or electric power) with respect to the fundamental controlling heater duty map, and the element low temperature controlling heater duty map has a low value (in the duty or electric power) with respect to the fundamental controlling heater duty map. Moreover, the element low temperature control or the element high temperature control can also be achieved by increasing or decreasing the predetermined duty with respect to the fundamental control heater duty map.

This control will be described with reference to the flow chart of FIG. 16.

When this routine is started at a predetermined timing, it is determined at step 601 whether the exhaust gas is in the rich gas atmosphere or needs an increased sensitivity to CO gas. If determined necessary, the routine advances to step 603, at which the low temperature controlling heater duty map is selected to control the element to a low temperature.

In case it is determined at step 601 that the increased sensitivity to the CO gas is unnecessary, the routine advances to step 602, at which whether the exhaust gas is in the lean gas atmosphere or needs an increased sensitivity to NO gas. If it is determined that the increased sensitivity is necessary, the routine advances to step 604, at which the high temperature controlling heater duty map is selected to control the element to a high temperature. In case it is determined at both steps 601 and 602 that the increased sensitivity is unnecessary, the routine advances to step 605, at which the fundamental controlling heater duty map is selected.

The operation of this embodiment will be described with reference to the time charts shown in FIG. 17. FIG. 17 presents the time charts at the time when the vehicle is driven at the running speed shown as (a).

Before time T1, the engine is started to start its warming-up to raise the engine temperature (b). When the run of the vehicle is started at time T1, the low load determination flag of the idle state is turned from ON to OFF (d). Simultaneously with this, the acceleration determination flag is turned from OFF to ON (g). On the basis of this determination result, the heater control is switched from the low temperature control to the high temperature control. Therefore, the target element impedance R is controlled to 20 Ω of the target of the high temperature control, and the element temperature R is controlled to 720° C. as shown as (i) and (j).

When the time shifts to T2 so that the state changes from an acceleration to a steady or normal run, it is determined on the basis of the low temperature determination flag (c) that the component of the exhaust gas discharged is predominantly of the rich gas, and the heater control of the first oxygen sensor 25 is switched to the low temperature control. At this time, the element impedance R is controlled to 1,000 Ω (h) so that the element temperature is controlled to 420° C. (I and j).

When the engine is idle at time T3, the low load determination flag is turned from OFF to ON (d). At this time, the target impedance is controlled to 1,000 Ω for the low temperature of the first oxygen sensor element, and the rich gas is detected more sensibly, so that a slightly lean air/fuel ratio control can be made to set the target air/fuel ratio slightly lean with respect to the stoichiometric air/fuel ratio.

In the case of an acceleration state at time T4, moreover, the low load determination flag is turned from ON to OFF (c), and the acceleration determination flag is turned from OFF to ON (g). As a result, the heater control of the first oxygen sensor 25 is switched to the high temperature control so as to detect the NOx (i.e., the lean gas), as mostly discharged at the acceleration, highly precisely.

Therefore, the target impedance is set to 20 Ω, and the element temperature becomes high (e.g., 720° C.) so that the reactivity to the lean gas is better improved. Therefore, the output (k) of the first oxygen sensor 25 can react instantly, as shown, on the NOx discharge at the acceleration, so that the air/fuel ratio correction quantity λc (l) is instantly increased. The discharge of NOx can be reduced more by executing the air/fuel ratio control than the related art indicated with a dotted line in (m) so that the improvement in the emission ability can be improved.

At time T5, the acceleration state is ended so that the acceleration determination flag is turned from ON to OFF (g). Therefore, the heater high temperature control is switched to the normal temperature control.

At time T6, the running state is switched to the high load so that the high load determination flag (f) is turned from OFF to ON with the intake air flow or the throttle opening. In the high load state, the discharge of NOx is so high that a precise detection of the lean gas is demanded. Therefore, the heater low temperature control is executed as at times T4 and T6, and the $O_2$ sensor can enhance the reaction sensitivity of the lean gas so that the lean output (or the low voltage output) is instantly outputted, as shown, with the sensor output (k). This lean output is detected by the ECU 29 so that the air/fuel ratio correction quantity (l) is instantly increased to reduce the discharge of the NOx (m).

At time T7, the throttle is fully closed to execute the fuel cut-off F/C as shown as (e). The return from the fuel cut-off is indicated at time T8, but the reduction of the purification efficiency of NOx has to be prevented at the next acceleration time by feeding the rich gas in an increased quantity to the catalyst at the time of returning the fuel cut thereby to reduce the $O_2$ quantity in the catalyst. In order to feed the rich gas forcibly, it is necessary to prevent the excessive discharge of the rich gas. Therefore, a sensitive detection of the rich gas is needed to switch the heater control to the low temperature control from the instant of the fuel cut-off.

By thus switching the $O_2$ sensor heater control from the high, low and normal temperatures in accordance with the running state, the detection precision of the individual exhaust gas components by the $O_2$ sensor can be improved. As a result, in the air/fuel ratio feedback control of the exhaust gas, as has been described with reference to FIG. 2 to FIG. 4, either with the target voltage of the first oxygen sensor 25 being left at 0.45 V or by executing the air/fuel ratio feedback to the changed target voltage of the oxygen sensor 25 set by the output of the second oxygen sensor 26, the sensitivity to the exhaust gas of a less concentration is improved over that of the conventional system thereby to improve the emission ability.

In the above embodiment, the heater control is made at the three stages of the high, low and normal temperatures, but the three stages are not necessarily essential. For another application, the oxygen sensor element temperature can be changed to other multiple stages with a view to improving the desired exhaust gas detection precision.

Second Embodiment

In the second embodiment, the target impedance setting routine is differentiated from that in the first embodiment (FIG. 14), as shown in FIG. 18. The flow chart of FIG. 18 is started at a predetermined timing. When this routine is started, it is determined at step 501 whether or not the fuel supply is resumed from the fuel cut-off (F/C). At step 502, moreover, it is determined whether or not the fuel supply is being increased due to the return from the fuel cut-off. In case the answer of either of the determinations is No, the routine advances to step 506, at which the target impedance R is set to 100 Ω (e.g., 570° C.) for the normal temperature control.

In case the return from fuel cut-off is determined at step 501 and in case it is determined at step 502 that the fuel is being increased, the routine advances to step 503, at which it is determined whether or not the first oxygen sensor output VOX is less than 0.45 V (stoichiometry). In case of more than 0.45 V, it is determined that the catalyst is enriched by the increased fuel, and the routine advances to step 505, at which the fuel increase is instantly stopped. After this, the routine advances to step 506, at which the target impedance is set to control the $O_2$ sensor element to the normal temperature.

In case it is determined at step 503 that the $O_2$ sensor output VOX is less than 0.45 V, it is determined that much $O_2$ still exists in the catalyst. In order to instantly detect a trace quantity of rich gas to leak from the rich gas feed, the heater control is switched at step 504 to the low temperature one, in which the $O_2$ sensor element can be used at a low temperature for a higher sensitivity to the rich gas. As a result, the excessive discharge of the rich gas just after the return from the fuel cut-off can be prevented to improve the emission ability.

The control behaviors of this embodiment will be described with reference to the time charts of FIG. 19.

When the fuel cut-off is executed at time T10, the first oxygen sensor output VOX takes a low voltage indicating a lean air/fuel ratio. When the return from the fuel cut-off is made at time T20 by the reduction of the engine speed, the state, in which much $O_2$ is fed to the catalyst, is switched to a neutral point so that the fuel increase following the return from the fuel cut-off is executed.

Here in the state where the oxygen sensor has a low detection sensitivity to the rich gas (CO) as in the related art, whether or not the catalyst comes to the neutral point cannot be determined till time T40 so that the $O_2$ quantity is frequently small in the catalyst. In this embodiment, however, the reactivity of the rich gas (CO) is improved by changing the oxygen sensor element into a low temperature one so that the oxygen sensor element can respond to a trace quantity of rich gas at time T30. In case the oxygen sensor output indicates the rich state (0.45 V), the fuel increase is instantly stopped so that the reduction of $O_2$ in the catalyst can be suppressed to make the control neutral.

In another example, some engine is controlled to have a small increase of fuel following the return from the fuel cut-off while avoiding the rich gas discharge. In this case, in order to suppress the NOx discharge at acceleration just after the return from the fuel cut-off, the $O_2$ sensor element temperature had better be set so high as to improve the reactivity to the lean gas (NOx).

In order to thus suppress the exhaust gas, it is desirable to control the $O_2$ sensor element temperature in accordance with the engine running state and the exhaust gas component by the engine control.

The first and second embodiments have been described on the first oxygen sensor 25, but the invention can be likewise applied to the air/fuel ratio sensor 24 and the second oxygen sensor 26. The invention can be applied to an exhaust sensor for detecting a gas reaction at its electrode and does not limit the kind of the exhaust sensor.

What is claimed is:

1. An exhaust gas purifying system for an internal combustion engine comprising:

air/fuel ratio detecting means made by arranging an electrode at a solid electrolyte element, for detecting an air/fuel ratio in an exhaust gas coming from an engine;

temperature adjusting means for adjusting a temperature of the solid electrolyte element in the air/fuel ratio detecting means to a predetermined temperature; and priority determining means for determining such a specific gas in the exhaust gas as to have priority in sensitivity, wherein the specific gas in the exhaust aas which is determined by the priority determining means to have priority in sensitivity is selectively changed during operation of the engine, and the temperature adjusting means adjusts the temperature of the solid electrolyte element in response to the selective change in the specific gas determined by the priority determining means so as to change a detection sensitivity to the specific gas determined by the priority determining means.

2. An exhaust gas purifying system for an internal combustion engine comprising:

air/fuel ratio detecting means made by arranging an electrode at a solid electrolyte element, for detecting an air/fuel ratio in an exhaust gas coming from an engine;

temperature adjusting means for adjusting a temperature of the solid electrolyte element in the air/fuel ratio detecting means, to a predetermined temperature; and running state detecting means for detecting a running state of the engine, wherein a specific gas in the exhaust gas to be detected is selectively changed during operation of the engine, and the temperature adjusting means adjusts the temperature of the solid electrolyte element in response to the selective change in the specific gas to be detected so as to change a detection sensitivity to the specific gas in the exhaust to be detected on the basis of the running state detected by the running state detecting means.

3. An exhaust gas purifying system for an internal combustion engine according to claim 1, wherein the temperature adjusting means adjusts the temperature of the solid electrolyte element by estimating the temperature of the solid electrolyte element by detecting the internal resistance of the air/fuel ratio detecting means.

4. An exhaust gas purifying system for an internal combustion engine according to claim 1, wherein the temperature adjusting means determines the calorie for adjusting the temperature of the solid electrolyte element by at least either an exhaust temperature sensor or a parameter relating to an exhaust temperature.

5. An exhaust gas purifying system for an internal combustion engine according to claim 1, wherein the temperature adjusting means determines a calorie for adjusting the temperature of the solid electrolyte element by the parameter relating to the exhaust temperature, and the parameter relating to the exhaust temperature is at least one of an engine load, an engine speed, an intake air flow, a throttle opening, a fuel injection rate and an engine warming state.

6. An exhaust gas purifying system for an internal combustion engine according to claim 2, wherein the running state detecting means uses a parameter relating to an exhaust gas component detected by the air/fuel ratio detecting means, as a parameter for detecting the running state.

7. An exhaust gas purifying system for an internal combustion engine according to claim 6, wherein the parameter relating to the exhaust gas component detected by the air/fuel ratio detecting means is at least one of an engine load, an engine speed, an intake air flow, an engine warming sate, an air/fuel ratio, a fuel injection rate and a catalyst state.

8. An exhaust gas purifying system for an internal combustion engine according to claim 7, wherein the catalyst state includes at least one of a catalyst temperature, a catalyst outflow gas temperature and an air/fuel ratio in the catalyst.

9. An exhaust gas purifying system for an internal combustion engine according to claim 1, wherein the priority determining means sets the specific gas, if estimated to increase in its discharge, as the gas to be given priority to the sensitivity.

10. An exhaust gas purifying system for an internal combustion engine according to claim 9, wherein the priority determining means estimates the specific gas estimated to increase in its discharge in accordance with the change in the running condition.

11. An exhaust gas purifying system for an internal combustion engine according to claim 10, wherein the change in the running condition is a change from a low load to a high load of the parameter relating to the engine load.

12. An exhaust gas purifying system for an internal combustion engine according to claim 9, wherein the priority determining means estimates the specific gas to be estimated in the increase in its discharge in accordance with the change in the air/fuel ratio.

13. An exhaust gas purifying system for an internal combustion engine according to claim 1, wherein the temperature adjusting means makes such an adjustment that the temperature of the solid electrolyte element may be higher at the high load than at the low load.

14. An exhaust gas purifying system for an internal combustion engine according to claim 2, further comprising:

a catalyst disposed in an exhaust gas passage of the internal combustion engine for purifying the exhaust gas;

an upstream air/fuel ratio sensor disposed on the upstream of the catalyst for detecting the air/fuel ratio in the exhaust gas; and a downstream air/fuel ratio sensor disposed on the downstream side of the catalyst for detecting the air/fuel ratio in the exhaust gas, wherein the temperature adjusting means adjusts the temperature of the solid electrolyte element of the downstream air/fuel ratio sensor in accordance with the engine running state.

15. An exhaust gas purifying system for an internal combustion engine according to claim 1, further comprising:

a catalyst disposed in an exhaust gas passage of the internal combustion engine for purifying the exhaust gas;

an upstream air/fuel ratio sensor disposed on the upstream of the catalyst for detecting the air/fuel ratio in the exhaust gas; and a downstream air/fuel ratio sensor disposed on the downstream side of the catalyst for detecting the air/fuel ratio in the exhaust gas, wherein the temperature adjusting means adjusts the temperature of the solid electrolyte element of the downstream air/fuel ratio sensor so that the sensitivity may be improved to the specific gas, as given priority by the priority determining means in the exhaust gas.

16. An exhaust gas purifying system for an internal combustion engine according to claim 1, wherein the temperature adjusting means makes such an adjustment on the basis of the parameter relating to the engine load that the temperature of the solid electrolyte element may be the higher at the higher load than at the lower load.

17. An exhaust gas purifying system for an internal combustion engine according to claim 1, wherein the temperature adjusting means makes such an adjustment that the temperature of the solid electrolyte element may be higher when the air/fuel ratio is lean than when the same is rich.

18. An exhaust gas purifying system for an internal combustion engine according to claim 1, further comprising:

a catalyst disposed in an exhaust gas passage of the internal combustion engine for purifying the exhaust gas;

an upstream air/fuel ratio sensor disposed on the upstream of the catalyst for detecting the air/fuel ratio in the exhaust gas; and a downstream air/fuel ratio sensor disposed on the downstream side of the catalyst for detecting the air/fuel ratio in the exhaust gas, wherein the temperature adjusting means adjusts the temperature of the solid electrolyte element in accordance with the air/fuel ratio upstream of the catalyst.

19. An exhaust gas purifying system for an internal combustion engine according to claim 2, wherein the temperature adjusting means raises the temperature of the solid electrolyte element thereby to increase reactivity to a lean gas when the running state detecting means detects a high load or an acceleration of the engine.

20. An exhaust gas purifying system for an internal combustion engine according to claim 2, wherein the temperature adjusting means reduces the temperature of the solid electrolyte element thereby to increase reactivity to a rich gas when the running state detecting means detects a low load under low temperature or a deceleration of the engine.

21. A method of purifying exhaust gas from an internal combustion engine, the method comprising:

detecting an air/fuel ratio in an exhaust gas coming from an engine using an air/fuel ratio sensor having an electrode at a solid electrolyte element;

during operation of the engine, selectively determining a first specific component gas from a plurality of component gases in the exhaust gas to have priority in sensitivity or a second specific component gas, different from the first specific component gas, from the plurality of component gases in the exhaust gas to have priority in sensitivity, and changing the temperature of the solid electrolyte element in the air/fuel ratio sensor to a predetermined temperature in response to the selective determination of the first specific component gas or the second specific component gas having priority in sensitivity so as to change a detection sensitivity to the specific component gas determined to have priority in sensitivity.

22. A method of purifying exhaust gas from an internal combustion engine, the method comprising:

detecting an air/fuel ratio in an exhaust gas from an engine using an ak/fuel ratio sensor having an electrode at a solid electrolyte element;

adjusting a temperature of the solid electrolyte element in the air/fuel ratio sensor to a predetermined temperature; and determining a specific component gas from a plurality of component gases in the exhaust gas as having priority in sensitivity;

wherein the specific component gas in the exhaust gas which is determined to have priority in sensitivity is selectively changed during operation of the engine so that another specific component gas in the exhaust gas is determined to have priority in sensitivity, and the temperature of the solid electrolyte element is adjusted in response to the selective change in the specific component gas determined to have priority in sensitivity so as to,change detection sensitivity to the another specific component gas determined to have priority in sensitivity.

23. A method of purifying exhaust gas from an internal combustion engine, the method comprising:

detecting an air/fuel ratio in an exhaust gas from an engine using an air/fuel ratio sensor having an electrode at a solid electrolyte element;

adjusting a temperature of the solid electrolyte element in the air/fuel sensor to a predetermined temperature; and detecting the running state of the engine;

wherein a specific component gas in the exhaust gas to be detected is selectively changed during operation of the engine so that another specific component gas in the exhaust gas is to be detected, and the temperature of the solid electrolyte element is adjusted in response to the selective change in the specific component gas to be detected so as to change a detection sensitivity to the another specific component gas in the exhaust gas on the basis of the detected running state.

* * * * *